US010002487B2

(12) United States Patent
Castellani

(10) Patent No.: US 10,002,487 B2
(45) Date of Patent: Jun. 19, 2018

(54) DISPENSING APPARATUS FOR DISPENSING A FOOD PRODUCT

(71) Applicant: KONINKLIJKE PHILIPS N.V., Eindhoven (NL)

(72) Inventor: Andrea Castellani, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days. days.

(21) Appl. No.: 14/911,896

(22) PCT Filed: Aug. 4, 2014

(86) PCT No.: PCT/EP2014/066670

§ 371 (c)(1),
(2) Date: Feb. 12, 2016

(87) PCT Pub. No.: WO2015/022212

PCT Pub. Date: Feb. 19, 2015

(65) Prior Publication Data

US 2016/0196711 A1 Jul. 7, 2016

(30) Foreign Application Priority Data

Aug. 14, 2013 (EP) ..... 13180357

(51) Int. Cl.
*G07F 13/06* (2006.01)
*G07F 9/02* (2006.01)
*G07F 11/00* (2006.01)

(52) U.S. Cl.
CPC ..... *G07F 13/065* (2013.01); *G07F 9/026* (2013.01); *G07F 11/002* (2013.01)

(58) Field of Classification Search
CPC ..... G07F 13/06; G07F 11/00; G07F 9/02
See application file for complete search history.

(56) References Cited

U.S. PATENT DOCUMENTS

2003/0074106 A1* 4/2003 Butler ..... G06Q 10/087 700/236
2003/0125836 A1* 7/2003 Chirnomas ..... G07F 9/02 700/236

(Continued)

FOREIGN PATENT DOCUMENTS

EP 2345352 A1 7/2011
WO 03005295 A1 1/2003

(Continued)

OTHER PUBLICATIONS

Christof Roduner, "Mobile Devices for Interacting with Tagged Objects: Development Support and Usability", pp. 1-182, Diss ETH No. 18876, 2010.

*Primary Examiner* — Gene Crawford
(74) *Attorney, Agent, or Firm* — Dorsey & Whitney LLP

(57) ABSTRACT

A dispensing apparatus (200) for dispensing a food product, the dispensing apparatus comprising a receptacle (210) for receiving a supply (510), a dispensing unit (220) configured to dispend portions of the food product, dispensing a portion of the food product consuming an amount of the supply, an electronic counting unit (232) configured to represent an amount of authorized supply, the counting unit is configured to decrease the amount of authorized supply when the dispensing unit dispenses a portion of the food product, the dispensing unit being configured to block dispensing of the food product if the amount of authorized supply is below a minimum authorized supply amount, a communication unit (240) configured to receive a digital authorization message from an authorization server (400) through mobile communication device (300), the authorization server being external to the dispensing apparatus, and a dispensing authorization unit (230) configured to obtain from the authorization message a supply authorization amount, and to increase the (Continued)

300
DISPENSING SYSTEM amount of authorized supply represented by the counting unit with the supply authorization amount.

17 Claims, 4 Drawing Sheets

(56) References Cited

U.S. PATENT DOCUMENTS

| | | | | |
|---|---|---|---|---|
| 2006/0108415 | A1* | 5/2006 | Thomas | B67D 1/0884<br>235/381 |
| 2007/0187425 | A1* | 8/2007 | Knepler | A47J 31/4492<br>221/221 |
| 2013/0220134 | A1* | 8/2013 | Giua | A47J 31/3676<br>99/280 |
| 2014/0134299 | A1* | 5/2014 | Guidorzi | A47J 31/44<br>426/87 |

FOREIGN PATENT DOCUMENTS

| | | | |
|---|---|---|---|
| WO | 2005003022 | A1 | 1/2005 |
| WO | 2011000021 | A1 | 1/2011 |
| WO | 2012059892 | A1 | 5/2012 |
| WO | 2013011078 | A1 | 1/2013 |
| WO | 2013019973 | A1 | 2/2013 |

* cited by examiner

DISPENSING APPARATUS FOR DISPENSING A FOOD PRODUCT

This application is the U.S. National Phase application under 35 U.S.C. § 371 of International Application No. PCT/EP2014/066670, filed on Aug. 4, 2014, which claims the benefit of International Application No. 13180357.9 filed on Aug. 14, 2013. These applications are hereby incorporated by reference herein.

FIELD OF THE INVENTION

The invention relates to a dispensing apparatus for dispensing a food product, a mobile communication device and an authorization server.

BACKGROUND OF THE INVENTION

In the professional food and automatic service market it is not uncommon that an apparatus for dispensing a food product is supplied for free to a location manager by the provider of the food products. However, this is done under the condition that the machine is only supplied with products of the provider.

Examples of dispensing apparatuses include: Vending machines, Bar Coffee machines, office coffee machines, and the like.

Because the costs of the machine have to be covered through selling of the food products, it is important to the provider that the machine works exclusively with the products he provides.

To get this result, the dispensing apparatus can be equipped with a device that recognizes if a given food package comes from the authorized provider. Such recognition devices are expensive, even compared to the price of the dispensing apparatus, making this option less than satisfactory.

SUMMARY OF THE INVENTION

It would be advantageous to have an improved system for dispensing food products, in which on the one hand some control is exerted over the supplies used in a dispensing apparatus, yet the dispensing apparatus does not require recognition device for determining if a supply comes from an authorized provider. A system is provided comprising a dispensing apparatus for dispensing a food product and a mobile communication device. Embodiments of the system further comprise an authorization server and/or a supply package.

The dispensing apparatus comprises a receptacle for receiving a supply, a dispensing unit configured to dispend portions of the food product, dispensing a portion of the food product consuming an amount of the supply, an electronic counting unit configured to represent an amount of authorized supply, the counting unit is configured to decrease the amount of authorized supply when the dispensing unit dispenses a portion of the food product, the dispensing unit being configured to block dispensing of the food product if the amount of authorized supply is below a minimum authorized supply amount, a communication unit configured for communication with a mobile communication device, the communication unit being configured to receive a digital authorization message from an authorization server through the mobile communication device, the authorization server being external to the dispensing apparatus, and a dispensing authorization unit configured to obtain from the authorization message a supply authorization amount, and to increase the amount of authorized supply represented by the counting unit with the supply authorization amount.

The mobile communication device comprises a supply identification unit for obtaining a supply identifier of a supply package, the supply package containing a supply for use in a receptacle for receiving a supply of a dispensing apparatus, a first communication unit configured to communicate with a dispensing apparatus via radio signals for receiving an apparatus identifier, a second communication unit configured to communicate with an authorization server via a communications network, a message control unit configured to send the supply identifier obtained from the supply identification unit and the apparatus identifier obtained from the first communication unit to the authorization server via the second communication unit, configured to receive from the authorization server a digital authorization message, and configured to send the authorization message to the dispensing apparatus.

The dispensing apparatus does not require a device that recognizes if a given food package comes from the authorized provider. The dispensing device does not authorize the product itself. When loaded with a supply the dispensing device will use the supply for dispensing, whether the supply comes from an authorized provider or not. For example, a user could try to circumvent the system by increasing the amount of authorized supply with a valid authorization messages but supply the dispensing apparatus with a supply obtained from an unauthorized source.

This circumvention will not be beneficial to the user however. The dispensing apparatus does require that the amount of authorized supply is increased from time to time. Increasing this number requires authorization messages. Obtaining an authorization message is done via a mobile communication device. The communication device reads a supply identity number from the supply package and uses this to obtain the authorization message.

Thus, although the system cannot enforce that authorized supplies are actually used in the dispensing, the system can enforce that new authorized supplies are bought. Moreover, a device to authorize supplies is not needed in the dispensing apparatus, but a communication device. Communication devices that are capable of reading a supply identifier are widespread, e.g., smart phones.

The system is well suited for supplies that are received in bulk and are not individually labeled with an identifier, but wherein only the supply package is individually labeled.

In an embodiment, the food product is a beverage. The dispensing unit may be configured to prepare the beverage from the amount of the supply and a liquid, e.g., water. In an embodiment, the supply is a dry powder, such as a coffee, tea or coca mixture. The supply may be a liquid, such as syrup. For supplies like liquids and powders, the system is especially advantageous since it is not required for the supply itself to carry a supply identifier.

In an embodiment, the dispensing unit is configured to prepare the food product from the amount of the supply and at least another ingredient, such as a powder or a liquid.

In an embodiment, the communication unit of the dispensing apparatus comprises an antenna configured to receive the digital authorization message encoded in a radio signal from the mobile communication device, the mobile communication device being configured to receive the digital authorization message from the authorization server over a communications network before sending the digital authorization message to the dispensing apparatus.

For example, the communication unit of the dispensing apparatus may be configured for short-range radio communication, such as Bluetooth communication. Such communication devices have much lower cost than devices for recognizing a supply. For example, the short-range radio communication may have a range of less than 5 meter or even less than 1 meter.

In an embodiment, the dispensing apparatus comprises a memory for storing an apparatus identifier for identifying the dispensing apparatus at the authorization server, the communication unit being configured for sending the apparatus identifier to the mobile communication device, the mobile communication device being configured to send the apparatus identifier to the authorization server before receiving the authorization message.

The mobile communication device may collect the apparatus identifier and supply identifier and send it to the authorization server. The authorization server can then generate an authorization message specifically for the dispensing apparatus. In this way the authorization server keeps informed about the use of the dispensing apparatuses. This information may be used to recall unused dispensing apparatuses, or to service heavily used ones.

It is possible to use the system without the apparatus identifier. In that case an authorization message would work on any compatible dispensing system.

In an embodiment, the dispensing authorization unit comprises a signature verifier configured to authenticate the authorization message by verifying a digital signature in the authorization message, wherein the amount of authorized supply is not increased if the signature verifier determined that the digital signature did not verify.

Through a signature the dispensing apparatus may verify the authenticity of the authorization message. The authorization message may also include a certificate signed by an authorization authority. In this way authorized providers may each be given a certificate and can then produce their own authorization messages. The supply identifier may include an URL of the authorization server. The mobile communication device is configured to use the URL in the second communication unit for connecting to the authorization server. Interestingly, even if a supply identifier would comprise a URL to a fake authorization server, this would not undermine the system if the dispensing apparatus is configured to verify a signature on the authorization message. Verifying a signature may include verifying a certificate, such as an X.509 certificate. X.509 certificates are described in RFC 5280 as updated by RFC 6818.

In an embodiment, the dispensing authorization unit comprises a replay protection unit, wherein the replay detection unit verifies that the authorization message is not a replay, wherein the amount of authorized supply is not increased if the replay detection unit determined that the authorization message is a replay.

Replay protection avoids that an authorization message is used twice. This avoids the use of unauthorized supplies.

An aspect of the invention concerns an authorization server. The authorization server comprises a communication unit and a server authorization unit.

The communication unit is configured to receive a supply identifier obtained from a supply package and an apparatus identifier obtained from a dispensing apparatus.

The server authorization unit is configured to authenticating the supply identifier and detecting replay of the supply identifier, configured to generate an authorization message for the dispensing apparatus if the supply identifier is authentic and no replay of the supply identifier was detected, the authorization message comprising a supply authorization amount, and to send the authorization message to the dispensing machine.

The authorization server, dispensing apparatus and mobile communication device are separate devices.

An aspect of the invention concerns a dispensing system. In an embodiment of the dispensing system, the system comprises a dispensing apparatus for dispensing a food product and a mobile communication device. In an embodiment of the dispensing system, the system comprises an authorization server.

An aspect of the invention concerns a method for dispensing a food product.

An aspect of the invention concerns a mobile communication method.

An aspect of the invention concerns an authorization method.

An aspect of the invention concerns a supply package for supplying a food dispensing apparatus as in any one of the preceding claims, the supply package comprising a machine-readable supply identifier and containing a supply, the supply identifier uniquely identifying the supply package amongst multiple supply packages.

For example, each supply package of the multiple supply packages may contain a unique supply identifier. The supply identifier may be a random number. For example, a supply identifier having 32 random bits is very likely to be unique.

An aspect of the invention concerns the use of a supply package, the supply package comprising a machine-readable supply identifier and containing a supply for a food dispensing apparatus in a method according to the invention.

The dispensing apparatus described herein saves cost and increases flexibility using features already available in commonly available devices, e.g., smart phones.

The dispensing apparatus, mobile communication device and authorization server are electronic devices. The mobile communication device may be a mobile phone, or tablet computer. Dispensing apparatus, mobile communication device and authorization server may comprise a computer.

A method according to the invention may be implemented on a computer as a computer implemented method, or in dedicated hardware, or in a combination of both. Executable code for a method according to the invention may be stored on a computer program product. Examples of computer program products include memory devices, optical storage devices, integrated circuits, servers, online software, etc. Preferably, the computer program product comprises non-transitory program code means stored on a computer readable medium for performing a method according to the invention when said program product is executed on a computer In a preferred embodiment, the computer program comprises computer program code means adapted to perform all the steps of a method according to the invention when the computer program is run on a computer. Preferably, the computer program is embodied on a computer readable medium.

BRIEF DESCRIPTION OF THE DRAWINGS

These and other aspects of the invention are apparent from and will be elucidated with reference to the embodiments described hereinafter. In the drawings.

Figure 1:
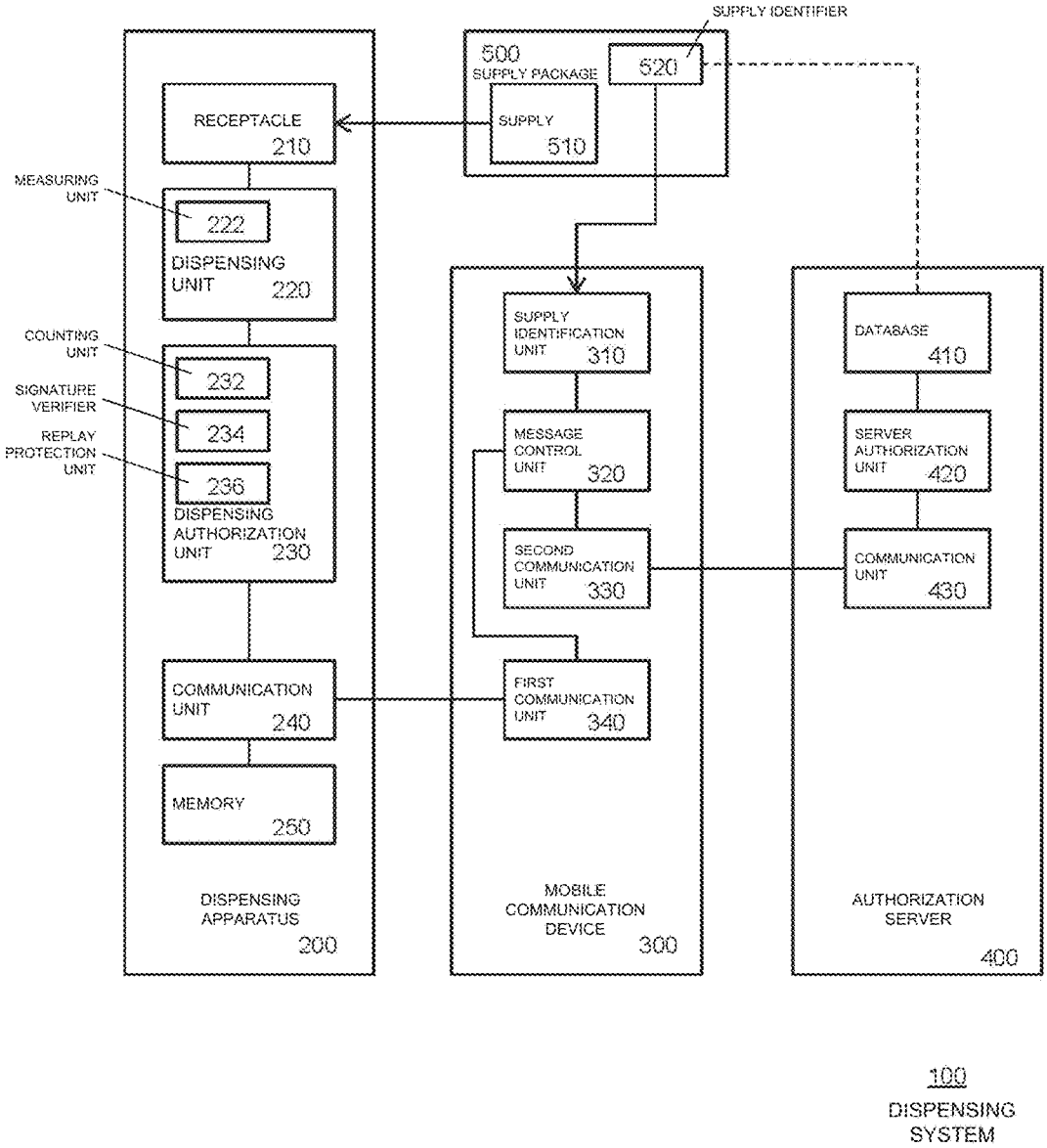
FIG. 1 is a block diagram illustrating a dispensing system.

It should be noted that items which have the same reference numbers in different Figures, have the same structural features and the same functions, or are the same signals. Where the function and/or structure of such an item has been explained, there is no necessity for repeated explanation thereof in the detailed description.

LIST OF REFERENCE NUMERALS IN FIG. 1

100 a dispensing system
200 a dispensing apparatus
210 a receptacle
220 a dispensing unit
222 a measurement unit
230 a dispensing authorization unit
232 a counting unit
234 a signature verifier
236 a replay protection unit
240 a communication unit
250 a memory
300 a mobile communication device
310 a supply identification unit
320 a message control unit
330 a second communication unit
340 a first communication unit
400 an authorization server
410 a database
420 a server authorization unit
430 a communication unit
500 a supply package
510 a supply
520 a supply identifier

DETAILED DESCRIPTION OF EMBODIMENTS

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described.

FIG. 1 is a block diagram illustrating a dispensing system 100.

Dispensing system 100 comprises: one or more dispensing apparatuses for dispensing a food product, shown is dispensing apparatus 200; one or more mobile communication devices, shown is mobile communication device 300; and an authorization server 400.

System 100 has been arranged so that the supplies used by dispensing apparatus 200 can be controlled centrally. In particular so that dispensing apparatus 200 may only use authorized supplies, e.g., only supplies of a particular manufacturer, distributor, packager and the like; while at the same time avoiding the introduction of controlling systems inside dispensing apparatus 200.

The shown dispensing apparatus 200 comprises a receptacle 210 for receiving a supply 510, and a dispensing unit 220 configured to dispend portions of the food product. Dispensing a portion of the food product consumes an amount of the supply.

For example, dispensing apparatus 200 may prepare the food product using part of the supply in receptacle 210. For example, dispensing apparatus 200 may prepare the food product using part of the supply in receptacle 210 according to a recipe such as stored in dispensing apparatus 200.

This may be done for example, if dispensing apparatus 200 is configured to dispense beverages, in particular heated beverages, such as coffee, tea and the like. Dispensing apparatus 200 may use additional products in preparing the food product, e.g., water (not shown). Dispensing apparatus 200 may also serve a pre-prepared beverage, e.g., a cold beverage. In such a case, dispensing apparatus 200 need only transfer part of the supply in receptacle 210 to an outlet. Dispensing apparatus 200 may also be configured to dispense dry food products, in particular, individually packaged products, e.g., candy bars.

Dispensing apparatus 200 is particularly advantageous for food products that are prepared from supplies that cannot be individually packaged, such as powders and liquids, e.g. coffee powder for preparing coffee or syrups for prepared drinks. The receptacle may be configured to receive a supply 510 as a powder or a liquid without a supply packaging 500.

Dispensing apparatus 200 may be configured to dispense multiple different food products. Different food products may require different supplies and/or use a different recipe. For example, dispensing apparatus 200 may be configured for two recipes, using a first and second amount of the supply respectively; e.g., to produce two different strengths, e.g., of strong or weak coffee.

For simplicity, we describe dispensing apparatus 200 for a single supply. However, dispensing apparatus 200 may have multiple receptacles for receiving multiple supplies.

Dispensing apparatus 200 comprises an electronic counting unit 232 that is configured to represent an amount of authorized supply. When the dispensing unit dispenses a portion of the food product the amount of authorized supply is decreased. For example, dispensing unit 220 may send a signal to counting unit 232 to decrease the amount represented.

For example, counting unit 232 may contain an electronic counter, e.g., a memory storing an amount in digital form. Various implementations are possible, e.g. having the counter count up or downwards, etc.

There are various ways to implement the decreasing of counting unit 232. In an advanced embodiment, dispensing unit 220 may comprise a measurement unit 222 configured to measure the amount of the supply consumed by dispensing a portion of the food product.

Measuring unit 222 is optional. Having measuring unit 222 may be useful, if the amount of supply consumed is determined to a large extent by a user of dispensing apparatus 200. However, if the amount of supply consumed is mostly determined by the product chosen by the user, it turns out that measuring unit 222 may be omitted.

For example, counting unit 232 may be configured to decrease the amount of authorized supply with a predetermined amount, i.e., determined before the dispensing unit starts dispensing the portion of the food product. For example, supply 510 may be a supply of 1000 grams. In this case, counting unit 232 may initially represent '1000'. For example, each serving of the food product may use 15 grams. In that case, counting unit 232 decreases the amount by 15, e.g., to 985, 970, . . . , etc. If dispensing apparatus 200 uses the supply in multiple recipes, each recipe may have an associated predetermined amount. Counting unit 232 may be configured to decrease the amount of authorized supply with the predetermined amount associated with the recipe used to prepare the food product. A recipe may be a set of software instructions stored in dispensing apparatus 200. For example, a strong coffee may use 18 grams.

In an embodiment, the dispensing apparatus stores multiple recipes for preparing food products, such as beverages, from at least the amount of the supply; the counting unit is configured to decrease the amount of authorized supply with a predetermined amount depending on the recipe of the food product.

If the amount of authorized supply is below a minimum authorized supply amount, then dispensing unit 220 blocks dispensing of the food product. For example, dispensing unit 220 may inspect counting unit 232 itself. For example, counting unit 232 may request permission from a dispensing authorization unit 230. For example, dispensing unit 220 may receive a blocking signal in case authorized supply is below a minimum authorized supply amount. The minimum amount may be stored in dispensing apparatus 200. The minimum authorized supply amount may be chosen as the minimum amount of supply needed for any recipe of dispensing apparatus 200.

Dispensing apparatus 200 comprises a communication unit 240 configured to receive a digital authorization message from an authorization server 400. The authorization server is external to the dispensing apparatus. There are various ways in which dispensing apparatus 200 may receive the authorization message. For example, communication unit 240 may be configured to communicate with authorization server 400 over a communications network, say the Internet. For example, communication unit 240 may comprise a network interface, such as an Ethernet interface or a wireless network interface.

In the embodiment shown in FIG. 1, communication unit 240 is configured to communicate with authorization server 400 using a mobile communication device 300 as an intermediary.

For example, communication unit 240 may comprise an antenna configured to receive the digital authorization message encoded in a radio signal from mobile communication device 300. This may be done as follows: authorization server 400 sends the digital authorization message to mobile communication device 300 over a communications network, and mobile communication device 300 sends the digital authorization message to dispensing apparatus 200. In this configuration, communication unit 240 may be configured for short-range radio communication. In particular, communication unit 240 may be a Bluetooth communication unit.

However, it is possible to avoid the use of mobile communication device 300 and communicate directly with authorization server 400, e.g., if communication unit 240 comprises a wireless network interface to a communications network, such as Wi-Fi.

Dispensing apparatus 200 comprises a dispensing authorization unit 230 configured to obtain from the authorization message a supply authorization amount, and to increase the amount of authorized supply represented by the counting unit with the supply authorization amount. FIG. 1 shows counting unit 232 as part of dispensing authorization unit 230, which is possible but not necessary.

Counting unit 232 may be configured with a maximum that corresponds to the size of receptacle 210. This avoids overflow of counting unit 232. If counting unit 232 would be increased to more than the maximum, then counting unit 232 is set to the maximum.

Dispensing authorization unit 230 may obtain the supply authorization amount form the authorization message by first decrypting the authorization message with a cryptographic key stored in dispensing apparatus 200. This makes it harder to reverse engineer the system. This step is entirely optional.

To increase security dispensing authorization unit 230 may comprise a signature verifier 234 and/or a replay protection unit 236.

Signature verifier 234 ensures that the authorization message was authorized, e.g. originated from, authorization server 400. For example, authorization server 400 may sign the authorized supply amount and include the resulting signature in the authorization message. The signing may use a private key of a public-private key pair. Dispensing apparatus 200 may store the public key of the same pair. Using the public key, dispensing apparatus 200 may verify a digital signature in the authorization message. There are multiple suitable signature schemes, RSA signatures being a suitable public-private key authentication mechanism.

In case signature verifier 234 cannot the digital signature, i.e., cannot establish that authenticity of the message, then the amount of authorized supply will not be increased. Signature verifier 234 thus prevents fake authorization messages.

Replay protection unit 236 is configured to verify that the authorization message is not a replay, wherein the amount of authorized supply is not increased if the replay detection unit determined that the authorization message is a replay.

For example, replay protection unit 236 may comprise a database. The database may identify previously received authorizing messages. For example, the data base may store those messages or a hash over those messages. Replay protection unit 236 finds that a message is not a replay if the database cannot identify said message.

For example, replay protection unit 236 may comprise a serial number memory (not separately shown). Replay protection unit 236 finds that a message is not a replay if the authorization message contains a serial number that is higher than the serial number stored in the serial number memory of replay protection unit 236. In that case, replay protection unit 236 stores the higher serial number in the serial number memory. The authorization messages created by authorization server 400 have an increasing serial number.

Dispensing apparatus 200 comprises a memory 250 storing an apparatus identifier for identifying the dispensing apparatus at the authorization server. Communication unit 240 is configured for sending the apparatus identifier to authorization server 400, e.g., through mobile communication device 300. Preferably, the apparatus identifier is unique, or at least unique within system 100.

FIG. 1 shows a supply package 500. Supply package 500 may be a carton, or other type of package. Supply package 500 contains a supply 510. Supply package 500 comprises a supply identifier 520. It may be that the package is discarded when supply 510 is loaded in receptacle 210. It may be that receptacle 210 is loaded with supply 510 and supply package 500 together. In a preferred embodiment supply identifier 520 is machine-readable. Supply package 500 may be an electronic tag configured for short-range radio communication, say an RFID tag. In a preferred embodiment supply identifier 520 is a barcode. The barcode may be a so-called 1-dimensional bar code or 2-dimensional barcode, e.g., a QR code. Supply identifier 520 may also be a human readable code, say an alpha-numeric code.

Even if dispensing apparatus 200 is configured to receive packaging of the supply 510, dispensing apparatus 200 need read the supply identifier thereof.

Dispensing system 100 comprises a mobile communication device 300. Using mobile communication device 300 in dispensing system 100 is most preferred. However is it possible to avoid using mobile communication device 300.

Mobile communication device 300 comprises a supply identification unit 310 for obtaining supply identifier 520 of supply package 500. For example, supply identification unit 310 may be configured to read supply identifier 520 from supply package 500 to obtain the supply identifier, e.g. to read a barcode from supply package 500. For example, mobile communication device 300 comprises a camera, and may be configured for reading supply identifier 520 by making a picture thereof. Mobile communication device 300 may be configured to decode the picture, e.g., if supply identifier 520 is a barcode, such as a QR code.

Mobile communication device 300 may determine the supply identifier from a camera picture, however, mobile communication device 300 may also send the picture to authorization server 400; Authorization server 400 is then configured to determine the supply identifier from the picture Mobile communication device 300 comprises a first communication unit 340 configured to communicate with dispensing apparatus 200 for receiving the apparatus identifier from memory 250. For example, dispensing apparatus 200 may send the apparatus identifier to mobile communication device 300 using radio, e.g., short-range, e.g., Bluetooth.

Mobile communication device 300 comprises a second communication unit 330 configured to communicate with authorization server 400 via a communications network. For example, second communication unit 330 may be configured for 3G or GSM data link or via internet through a local Wi-Fi modem if available.

Mobile communication device 300 comprises a message control unit 320 configured to send the supply identifier obtained from supply identification unit 310 and the apparatus identifier obtained from the dispensing apparatus 200 through first communication unit 340 to authorization server 400 via second communication unit 330.

Second communication unit 330 is configured to receive in return from authorization server 400 a digital authorization message.

Second communication unit 330 is configured to send that authorization message to dispensing apparatus 200 via first communication unit 340.

Mobile communication device 300 sends the apparatus identifier and supply identifier to the authorization server before receiving the authorization message. Mobile communication device 300 may be configured to encrypt and/or sign its communication with dispensing apparatus 200 and/or authorization server 400.

Mobile communication device 300 may be a mobile phone, in particular a so-called 'smartphone'. A smartphone is a mobile phone comprising a display, a camera, a processor and a memory. The smartphone is configured to receive software, so-called apps, in the memory and execute them with the processor. Execution of the app causes information to be displayed on the screen, e.g., instructions for the user on which steps to take, or information on the progress of the app. The smartphone may be configured to receive an app configured for executing a method for a mobile communication method on the smartphone. The app may be downloaded onto the smartphone from an app-server, storing the app.

Dispensing system 100 comprises an authorization server 400. Authorization server 400 comprises a communication unit 430 configured to receive a supply identifier 520 obtained from a supply package 500 and an apparatus identifier obtained from a dispensing apparatus 200. In FIG. 1, communication unit 430 is configured to communicate with second communication unit 330. Authorization server 400 receives both a supply identifier and an apparatus identifier from mobile communication device 300.

Authorization server 400 comprises a server authorization unit 420. Server authorization unit 420 is configured to authenticating the supply identifier and detecting replay of the supply identifier.

For example, authorization server 400 may comprise a database 410. Database 410 contains all supply identifiers used for supply packages. The supply identifiers are unique in the system. Database 410 may also store whether or not the supply identifier has been used before, i.e., whether or not authorization server 400 has generated an authorization message for the supply identifier before. Using a database is not a great burden in a server such as authorization server 400. The received supply identifier is authentic if and only if it is in database 410. If the received supply identifier is in database 410 but marked used (authorization message is sent), it is a replay.

To ensure authenticity the authorization message may also verify (with a public key) a signature that may have been embedded in the supply identifier (using a private key). This has the advantage that database 410 need not store all supply identifier that have been manufactured, only all supply identifiers for which server 400 generated an authorization message. This simplifies the logistics considerably since the creating of the signatures in the supply identifier need not be done by server 400.

For example, a record of database 410 may store the following information: supply identifier (as readable from the package, e.g., supply identifier 520), supply type, authorization sent (yes/no).

Server authorization unit 420 may further verify that the apparatus identifier is in the database. If not, there is some error, and the supply identifier should not be authorized nor marked used.

Server authorization unit 420 may further verify that the supply type is compatible with the apparatus. For example, database 410 may store for each apparatus identifier the compatible types. For example, the supply type may be soup, but dispensing apparatus 200 may not support soup. If the supply type is not included in the compatible types, the supply identifier should not be authorized and marked used.

Database 410 may further store information on the serial number in the serial number memory, if a replay protection unit 236 is used. For example, database 410 may store the serial number included in the last authorization message sent to apparatus 200.

If server authorization unit 420 finds that the supply may be authorized, then server authorization unit 420 generates an authorization message for the dispensing apparatus. The authorization message comprises a supply authorization amount. The supply authorization amount may be equal to the amount in supply 510. For example, if supply package 500 contains 1000 gram, the supply authorization amount may be 1000 gram. To avoid blocking machines, that are not empty, the supply authorization amount may be chosen a higher than the content of supply package 500, say a percentage higher, say 10% higher. In the latter case, counting unit 232 is preferably configured with a maximum.

Server authorization unit 420 is configured to send the authorization message to the dispensing machine. This may be done by sending it to mobile communication device 300 via communication unit 430. This may also be done directly if dispensing apparatus 200 has a direct connection to authorization server 400.

Server 400 may include in the authorization message additional information for dispensing apparatus 200. For example, server 400 may include a new or updated recipe. Furthermore, apparatus 200 may send information for server 400 together with its apparatus identifier, e.g., status information, e.g., number of portions prepared, machine failure, etc.

Interestingly, central control over used supplies requires remarkably little hardware. In a simple embodiment, the machine contains a Bluetooth interface chip (instead of, say, an electronic-tag reader or barcode reader) and the supply package a barcode (instead of, say, an electronic tag). A modification in the commercial situation, such as a resale of the machine to another provider, may be adjusted at the authorization server, and does not require modification to the dispensing apparatus.

In an embodiment, the dispensing apparatus comprises multiple receptacles for receiving multiple supplies, the electronic counting unit is configured to represent multiple amounts of authorized supply corresponding to the multiple supplies, the counting unit is configured to decrease a particular amount of authorized supply when the dispensing unit dispenses a portion of the food product consumes part of the particular corresponding supply, the dispensing unit being configured to block dispensing of the food product if the amount of an authorized supply needed for dispensing the food product is below a minimum authorized supply amount of the needed supply, the dispensing authorization unit is configured to obtain from the authorization message a supply authorization amount for a particular supply, and to increase the particular amount of authorized supply corresponding to the particular supply represented by the counting unit with the supply authorization amount.

If desired mobile communication device 300 may be omitted from dispensing system 100. For example, authorization server 400 may receive an apparatus identifier and supply identifier through other means, e.g., entered at a website connected to authorization server 400. Authorization server 400 may send the authorization message directly to dispensing apparatus 200, e.g., if dispensing apparatus 200 comprises a Wi-Fi connection. However, this option is considered to be more cumbersome than the one shown in FIG. 1.

Typically, the devices 200, 300 and 400 each comprise a microprocessor (not shown) which executes appropriate software stored at devices 200, 300 and 400, e.g. that the software may have been downloaded and stored in a corresponding memory, e.g. RAM (not shown).

Figure 2A:
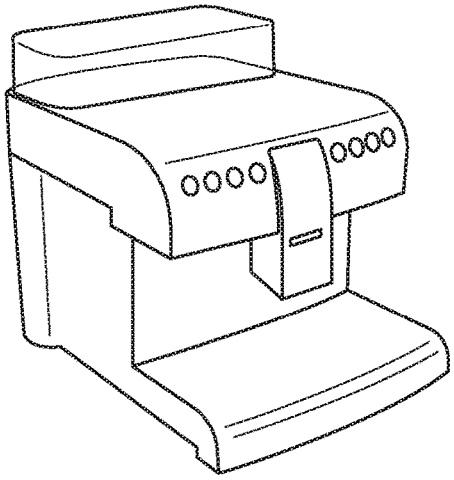
FIG. 2*a* illustrates a dispensing apparatus.
Figure 2B:
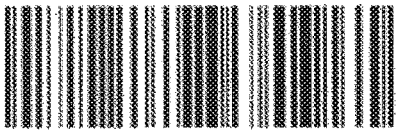
FIG. 2*b* illustrates a supply identifier.
Figure 2C:
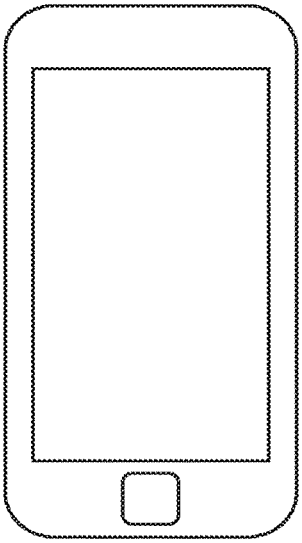
FIG. 2*c* illustrates a mobile communication device.

FIG. 2*a* shows an embodiment of dispensing apparatus 200. FIG. 2*b* shows an embodiment of supply identifier 520. FIG. 2*c* shows an embodiment of mobile communication device 300.

Figure 3A:
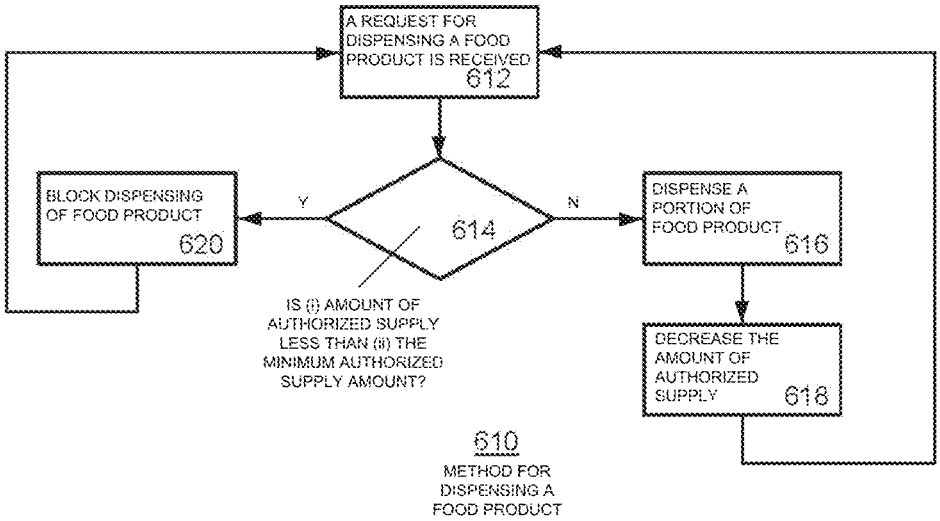
FIGS. 3*a* and 3*b* are flow charts illustrating a method for dispensing a food product.
Figure 3B:
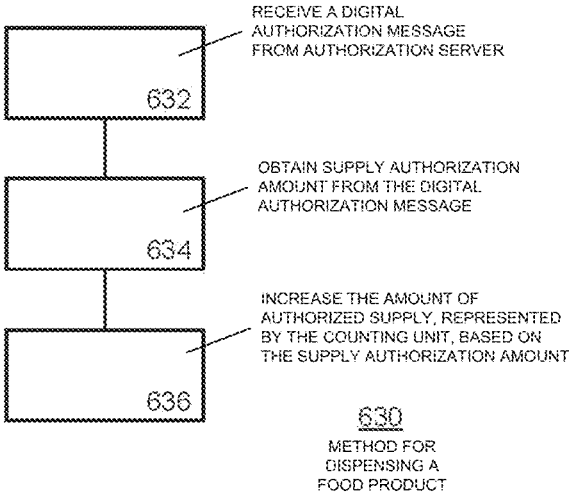

FIGS. 3*a* and 3*b* are flow charts illustrating a method for dispensing a food product, which may be used with dispensing apparatus 200. In FIG. 3*a* a dispensing method 610 is shown. In step 612, a request for dispensing a food product is received, e.g., a user presses one or more buttons of a dispensing apparatus. In step 614, an amount of authorized supply is compared to a minimum authorized supply amount. If the amount of authorized supply is less than the minimum authorized supply amount, the method continues in step 620. In step 620, dispensing of the food product is blocked. If the amount of authorized supply is more (or equal) than the minimum authorized supply amount, the method continues in step 616. In step 616, a portion of the food product is dispensed consuming an amount of the supply. In step 618 the amount of authorized supply is decreased. After steps 620 and 618 the method can receive a new request in step 612.

FIG. 3*b* shows a dispensing authorization method 630. In step 632, a digital authorization message is received from an authorization server. In step 634, a supply authorization amount is obtained from the authorization message. In step 636, the amount of authorized supply represented by the counting unit is increased with the supply authorization amount.

Methods 610 and 630 may be employed together or separately.

Figure 4:
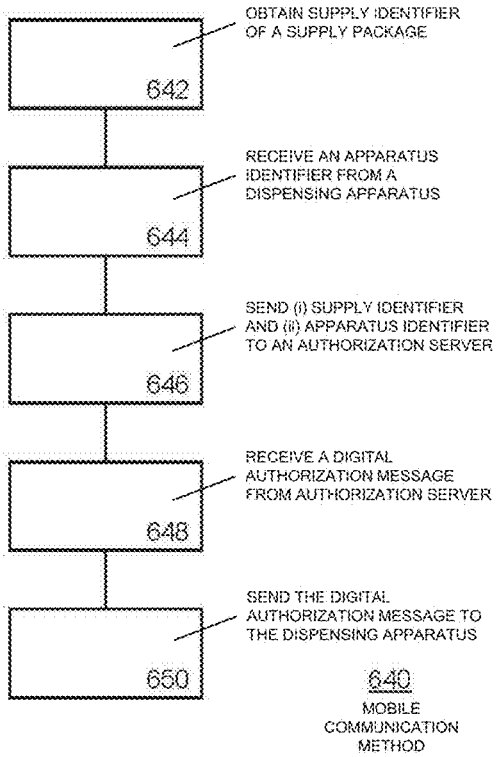
FIG. 4 is a flowchart illustrating a mobile communication method.

FIG. 4 is a flowchart illustrating a mobile communication method 640, which may be used with mobile communication device 300. In step 642, a supply identifier of a supply package is obtained. In step 644, an apparatus identifier is received from a dispensing apparatus. In step 646, the supply identifier obtained from the supply package and the apparatus identifier obtained from the dispensing apparatus are sent to an authorization server. In step 648, a digital authorization message is received from the authorization server. In step 650, the authorization message is send to the dispensing apparatus.

Figure 5:
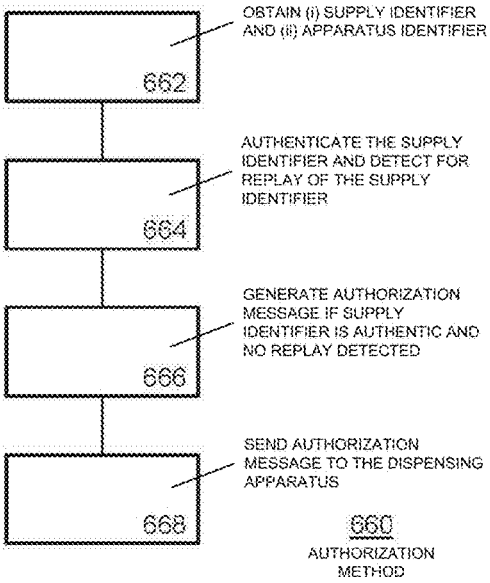
FIG. 5 is a flowchart illustrating an authorization method.

FIG. 5 is a flowchart illustrating an authorization method, which may be used with server 400. In step 662, a supply identifier obtained from a supply package and an apparatus identifier obtained from a dispensing apparatus are received. In step 664, the supply identifier is authenticated. Optionally, replay of the supply identifier is detected. In step 666, an authorization message for the dispensing apparatus is generated if the supply identifier is authentic and no replay of the supply identifier was detected, the authorization message comprising a supply authorization amount. In step 668 the authorization message is sent to the dispensing machine.

Many different ways of executing the methods are possible, as will be apparent to a person skilled in the art. For example, the order of the steps can be varied or some steps may be executed in parallel. Moreover, in between steps other method steps may be inserted. The inserted steps may represent refinements of the method such as described herein, or may be unrelated to the method. For example, methods 610, 630, 640, and 660 may be executed, at least partially, in parallel. Moreover, a given step may not have finished completely before a next step is started.

A method according to the invention may be executed using software, which comprises instructions for causing a processor system to perform methods 610, 630, 640, and 660. Software may only include those steps taken by a particular sub-entity of the system. The software may be stored in a suitable storage medium, such as a hard disk, a floppy, a memory etc. The software may be sent as a signal along a wire, or wireless, or using a data network, e.g., the Internet. The software may be made available for download and/or for remote usage on a server.

It will be appreciated that the invention also extends to computer programs, particularly computer programs on or in a carrier, adapted for putting the invention into practice. The program may be in the form of source code, object code, a code intermediate source and object code such as partially compiled form, or in any other form suitable for use in the implementation of the method according to the invention. An embodiment relating to a computer program product comprises computer executable instructions corresponding to each of the processing steps of at least one of the methods set forth. These instructions may be subdivided into subroutines and/or be stored in one or more files that may be linked statically or dynamically. Another embodiment relating to a computer program product comprises computer executable instructions corresponding to each of the means of at least one of the systems and/or products set forth.

It should be noted that the above-mentioned embodiments illustrate rather than limit the invention, and that those skilled in the art will be able to design many alternative embodiments.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A dispensing apparatus for dispensing a food product, the dispensing apparatus comprising:

a receptacle for receiving a supply of the food product from a supply package, the supply package having a supply identifier that uniquely identifies the supply package;

a dispensing unit configured to dispense portions of the food product from the receptacle, wherein dispensing a portion of the food product consumes an amount of the supply;

an electronic counting unit configured to represent an amount of authorized supply, wherein the electronic counting unit decreases the amount of authorized supply in response to the dispensing unit dispensing a portion of the food product, and wherein the dispensing unit is configured to block a dispensing of the food product in response to the amount of authorized supply falling below a minimum authorized supply amount;

a communication unit configured to communicate an apparatus identifier, unique to the dispensing apparatus, to a mobile communication device that is configured to obtain the supply identifier from the supply package, the communication unit further being configured to receive a digital authorization message from an authorization server through the mobile communication device, wherein the authorization server, being external to the dispensing apparatus, generates the digital authorization message based on (i) the supply identifier and (ii) the apparatus identifier of the dispensing apparatus communicated to the authorization server via the mobile communication device; and a dispensing authorization unit configured to obtain from the digital authorization message a supply authorization amount, wherein the dispensing authorization unit is further configured to increase the amount of authorized supply represented by the electronic counting unit based on the supply authorization amount.

2. The dispensing apparatus as in claim 1, wherein the food product is a beverage.

3. The dispensing apparatus as in claim 1, wherein the electronic counting unit is further configured to decrease the amount of authorized supply by a predetermined amount before the dispensing unit starts dispensing the portion of the food product.

4. The dispensing apparatus as in claim 1, wherein the communication unit comprises an antenna configured to receive the digital authorization message encoded in a radio signal from the mobile communication device, wherein the mobile communication device is configured to receive the digital authorization message from the authorization server over a communications network before sending the digital authorization message to the dispensing apparatus.

5. The dispensing apparatus as in claim 4, wherein the dispensing apparatus further comprises a memory for storing the apparatus identifier that identifies the dispensing apparatus at the authorization server, wherein the communication unit is further configured to send the apparatus identifier to the mobile communication device, and wherein the mobile communication device is further configured to send the apparatus identifier to the authorization server before receiving the authorization message.

6. The dispensing apparatus as in claim 1, wherein the dispensing authorization unit comprises a signature verifier configured to authenticate the authorization message by verifying a digital signature in the authorization message, and wherein the dispensing authorization unit does not increase the amount of authorized supply in response to the signature verifier determining that the digital signature did not verify.

7. The dispensing apparatus as in claim 1, wherein the dispensing authorization unit further comprises a replay protection unit, wherein the replay detection unit is configured to verify that the authorization message is not a replay, and wherein the dispensing authorization unit does not increase the amount of authorized supply in response to the replay detection unit determining that the authorization message is a replay.

8. A supply package for supplying a food product for use in the food dispensing apparatus of claim 1, the supply package comprising a machine-readable supply identifier and containing a supply, the supply identifier uniquely identifying the supply package amongst multiple supply packages.

9. A mobile communication device comprising a supply identification unit for obtaining a supply identifier that uniquely identifies a supply package, wherein the supply package contains a supply of food product for use in a receptacle that is configured to receive the supply of food product for a dispensing apparatus, further for being dispensed via a dispensing unit of the dispensing apparatus;

a first communication unit configured to communicate with a communication unit of the dispensing apparatus via radio signals for receiving an apparatus identifier unique to the dispensing apparatus;

a second communication unit configured to communicate with an authorization server via a communications network, wherein the second communication unit communicates both (i) the supply identifier of the supply package and (ii) the apparatus identifier of the dispensing apparatus to the authorization server, and wherein the authorization server is configured to communicate a digital authorization message to the second communication unit, wherein the digital authorization message is based on (i) the supply identifier and (ii) the apparatus identifier; and a message control unit configured to (i) send the supply identifier obtained from the supply identification unit and (ii) the apparatus identifier obtained from the first communication unit to the authorization server via the second communication unit, wherein the message control unit is further configured to receive from the authorization server the digital authorization message, via the second communication unit, and configured to send the digital authorization message, via the first communication unit, to the dispensing apparatus.

10. The mobile communication device of claim 9, wherein the supply identification unit is further configured to read a barcode of the supply package and to obtain the supply identifier from said read barcode.

11. A dispensing system comprising a dispensing apparatus for dispensing a food product as in claim 1 and a mobile communication device as in claim 9.

12. An authorization server, comprising:

a communication unit configured to receive (i) a supply identifier obtained from a supply package that uniquely identifies the supply package and (ii) an apparatus identifier obtained from a dispensing apparatus that is unique to the dispensing apparatus; and a server authorization unit configured to authenticate the supply identifier and to detect a replay of the supply identifier, wherein the server authorization unit is further configured to (i) generate an authorization message specifically for the dispensing apparatus in response to determining that the supply identifier is authentic and no replay of the supply identifier was detected, wherein the authorization message comprises a supply authorization amount, and (ii) send the authorization message to the dispensing apparatus, via the communication unit.

13. A method for dispensing a food product via a dispensing apparatus, the method comprising:

receiving, via a receptacle, a supply of the food product from a supply package, the supply package having a supply identifier that uniquely identifies the supply package;

dispensing, via a dispensing unit, portions of the food product from the receptacle, wherein dispensing a portion of the food product consumes an amount of the supply;

representing, via an electronic counting unit, an amount of authorized supply, and decreasing, via the electronic counting unit, the amount of authorized supply in response to the dispensing unit dispensing a portion of the food product, and blocking, via the dispensing unit, the dispensing of the food product in response to the amount of authorized supply falling below a minimum authorized supply amount;

communicating, via a communication unit, an apparatus identifier, unique to the dispensing apparatus, to a mobile communication device that is configured to obtain the supply identifier from the supply package, and receiving a digital authorization message from an authorization server, through the mobile communication device, wherein the authorization server generates the digital authorization message based on (i) the supply identifier and (ii) the apparatus identifier of the dispensing apparatus communicated to the authorization server via the mobile communication device;

obtaining, via a dispensing authorization unit, from the digital authorization message a supply authorization amount, and increasing, via the dispensing authorization unit, the amount of authorized supply represented by the electronic counting unit based on the supply authorization amount.

14. A computer program comprising computer program code means adapted to perform all the steps of claim 13 when the computer program is run on a computer.

15. A computer program as claimed in claim 14 embodied on a computer readable medium.

16. A mobile communication method comprising:

obtaining, via a supply identification unit, a supply identifier the uniquely identifies a supply package, wherein the supply package contains a supply of food product for use in a receptacle that is configured to receive the supply of food product for a dispensing apparatus, further for being dispensed via a dispensing unit of the dispensing apparatus;

receiving, via a first communication unit and a message control unit, an apparatus identifier unique to the dispensing apparatus from a communication unit of the dispensing apparatus;

sending, via a second communication unit and the message control unit, both (i) the supply identifier obtained from the supply package and (ii) the apparatus identifier obtained from the dispensing apparatus to an authorization server, wherein the authorization server is configured to communicate a digital authorization message to the second communication unit, wherein the digital authorization message is based on (i) the supply identifier and (ii) the apparatus identifier; and receiving from the authorization server, via the second communication unit and the message control unit, the digital authorization message, and sending the digital authorization message, via the message control unit and the first communication unit, to the dispensing apparatus, wherein a dispensing authorization unit of the dispensing apparatus is configured to obtain from the authorization message a supply authorization amount, wherein the dispensing authorization unit is further configured to increase an amount of authorized supply represented by an electronic counting unit based on the supply authorization amount.

17. An authorization method comprising receiving, via a communication unit, (i) a supply identifier obtained from a supply package that uniquely identifies the supply package and (ii) an apparatus identifier obtained from a dispensing apparatus that is unique to the dispensing apparatus;

authenticating via a server authorization unit, the supply identifier and detecting, via the server authorization unit, a replay of the supply identifier;

generating, via the server authorization unit, an authorization message specifically for the dispensing apparatus in response to determining that (i) the supply identifier is authentic and (ii) no replay of the supply identifier was detected, wherein the authorization message comprises a supply authorization amount; and sending, via the communication unit, the authorization message to the dispensing apparatus, wherein a dispensing authorization unit of the dispensing apparatus is configured to obtain from the authorization message a supply authorization amount, wherein the dispensing authorization unit is further configured to increase an amount of authorized supply represented by an electronic counting unit based on the supply authorization amount.

* * * * *